US005078926A

United States Patent [19]

McHenry et al.

[11] Patent Number: 5,078,926

[45] Date of Patent: Jan. 7, 1992

[54] RAPID STABILIZATION PROCESS FOR CARBON FIBER PRECURSORS

[75] Inventors: Edward M. McHenry, Milton; Francesco DeMaria, Gulf Breeze, both of Fla.

[73] Assignee: American Cyanamid Company, Stamford, Conn.

[21] Appl. No.: 883,861

[22] Filed: Jul. 11, 1986

Related U.S. Application Data

[63] Continuation of Ser. No. 587,100, Mar. 7, 1984, abandoned.

[51] Int. Cl.[5] ..... D01F 9/12

[52] U.S. Cl. ..... 264/29.2; 264/83; 264/182; 264/210.8; 423/447.6

[58] Field of Search ..... 264/29.2, 83, 18 L, 264/210.8; 423/447.6

[56] References Cited

U.S. PATENT DOCUMENTS

| | | | |
|---|---|---|---|
| 3,412,062 | 11/1968 | Johnson et al. | 260/37 |
| 4,002,426 | 1/1977 | Chenevey et al. | 264/29.2 |
| 4,113,847 | 9/1978 | Fukushima et al. | 264/29.2 |
| 4,256,607 | 3/1981 | Yoshida et al. | 264/29.2 |
| 4,347,279 | 8/1982 | Soji et al. | 264/29.2 |
| 4,362,646 | 12/1982 | Ikegami et al. | 264/29.2 |
| 4,413,110 | 11/1983 | Kauesh et al. | 526/348.1 |

*Primary Examiner*—James Derrington
*Attorney, Agent, or Firm*—Frank M. Van Riet

[57] ABSTRACT

Carbon fiber precursors are stabilized regarding their mechanical properties by conducting the stabilization procedure in at least two steps, the first at a temperature at which the maximum plasticity of the polymer is attained while stretching the fiber 10–50% and the second at 200°–300° C., but higher than the first.

9 Claims, No Drawings

RAPID STABILIZATION PROCESS FOR CARBON FIBER PRECURSORS

This application is a continuation of application Ser. No. 587,100, filed Mar. 7, 1984, now abandoned.

BACKGROUND OF THE INVENTION

Under previously recognized conditions of stabilization (oxidation), acrylonitrile polymer carbon precursor fibers are subjected to low temperatures i.e. 220°-250° C. for relatively long periods of time in order to avoid too rapid an exotherm which leads to breakage of the tows. U.S. Pat. No. 3,412,062 is representative of the prior art which teaches the stabilization of such fibers for 24-50 hours at 220° C. while preventing the fibers from shrinking more than 12% by applying tension thereto. In some instances, the fiber is allowed to stretch up to 36%.

SUMMARY OF THE INVENTION

The process of the present invention involves the stabilization of carbon fiber precursors in at least two stages. The first stage is conducted at a temperature at which the maximum plasticity of the polymer is attained while stretching the fiber from about 10-50%. The second stage is conducted, while the fiber is under tension, at a temperature ranging from about 200°-300° C., but higher than that of the first stage. Total residence time in both stages is 10-60 minutes.

Utilizing the novel process of the present invention, an increase in the production of carbon fiber is realized because of the much shorter time of stabilization. It has been surprisingly found that when the precursor tow is initially exposed to temperatures as near as possible to the polymer's temperature of maximum plasticization while simultaneously being stretched, the tow will not burn or disintegrate but rather maintains sufficient mechanical integrity to sustain even higher temperatures in each subsequent stage. Thus, the residence time of the fiber in the oxidation phase of the carbon fiber production is materially reduced.

DESCRIPTION OF THE INVENTION INCLUDING PREFERRED EMBODIMENTS

The process of the present invention is directed to the production of a carbon fiber precursor wherein an acrylonitrile polymer fiber is subjected to oxidation by heating said fiber in an oxidizing atmosphere for a time sufficient to permit substantially complete permeation of oxygen throughout the fiber structure. The processes encompasses the improvement which comprises conducting the stabilization (oxidation) in at least two stages, the first stage at a temperature substantially at which the maximum plasticity of the polymer is attained and while stretching the fiber from about 10-50%. The second stage is conducted while the fiber is maintained under a tension of from about 0.01-0.2 g/d and at a temperature ranging from about 200°-300° C. but in any event, higher than the temperature employed in the first stage. The total residence time of the fiber in the oxidation procedure ranges from about 15-60 minutes. When a third stage is employed, the tension of the fiber is maintained as in the second stage and at a temperature ranging from about 200°-300° C., but at least equal to that of the second stage.

The acrylonitrile fibers used herein are produced from polymers well known to those skilled in the art.

Although polyacrylonitrile per se can be employed, the polymer is usually a copolymer or terpolymer of at least about 85 weight percent of acrylonitrile and the remainder a comonomer or comonomers copolymerizable with the acrylonitrile. Useful comonomers include methyl methacrylate, acrylic acid, methacrylic acid, methylacrylate, acrylamide, β-hydroxypropyl acrylate and the like.

In the first stage of the oxidation process, as mentioned above, the polymer fiber is heated substantially to its maximum plasticity. The temperature at which the polymer exhibits its maximum plasticity is, of course, different for each polymeric system undergoing stabilization. Such temperature can be ascertained by testing of the polymer beforehand to determine at what temperature maximum plasticity is achieved. For the acrylonitrile polymers normally used in the production of carbon fibers, said temperature usually ranges from about 200°-275° C., generally from about 240°-260° C., and it is to this temperature most polymers must be heated in the first stage of the novel process set forth herein. The polymer is stretched from about b 10-50%, preferably from about 20-30% during the first stage heat treatment. The oxidation may be conducted in any oxygen containing media with air being preferred. Extraneous oxygen may be added, if desired.

While under a tension ranging from about 0.01-0.2 g/d, preferably from about 0.06-0.08 g/d, the fiber from the first oxidation stage is heated in the second stage to a temperature ranging from about 200°-300° C., preferably from about 220-270° C., but higher than that temperature employed in the first stage.

When a third stage is conducted, the tension on the fiber used in the second stage is maintained, however, a temperature ranging from about 200°-300° C., preferably from about 240°-300° C., but at least equal to that of the second stage, is employed.

The total residence time of the polymer fiber in the stages of the oxidation treatment ranges from about 15-60 minutes, preferably 20-45 minutes. When only two stages of oxidation are employed, the residence time of the fiber in the second stage should be at least about twice that of the fiber in the first stage. When three stages of stabilization are conducted, the residence time of the third stage should be about equal to that of the second stage, the second stage again being at least about twice that of the first stage.

Once the stabilized polymer fiber is recovered from the stabilization treatment, it can then be carbonized in the usual manner i.e. by heating to about 700°-1200° C. in an inert atmosphere. The carbonized fiber can then be further treated i.e. graphitized, by heating to a temperature of about 1200°-3000° C., again under inert conditions, such as taught in U.S. Pat. No. 4,413,110, incorporated herein by reference.

The following examples are set forth for purposes of illustration only and are not to be construed as limitations on the present invention except as set forth in the appended claims. All parts and percentages are by weight unless otherwise specified.

EXAMPLE 1

An acrylonitrile terpolymer containing approximately 91.3% acrylonitrile, 6.7% methylmethacrylate and 2.0% methacrylic acid is blended with 17.0% water and spun through a 55 micron spinnerette. A 1.3 d/f fiber is recovered with a total stretch of about 14×. The fiber is then stabilized by heating in air under the conditions set forth in Table I, below, wherein the stabilized fiber properties are also specified (Run A). Comparative results (Runs B & C) are also shown wherein oxidation of the same polymer fiber is conducted under conditions outside the scope of those of the instant process, i.e. those normally used during fiber stabilization.

TABLE I

| Stabilization Run | A | B (Comp) | C (Comp) |
|---|---|---|---|
| Total Residence time, min. | 30 | 120 | 120 |
| Stage 1 - Temp., °C. | 250 | 235 | 235 |
| Stage 1 - Stretch - % | 25 | 5 | 25 |
| Residence time, min. | 6 | 24 | 24 |
| Stage 2 - Temp., °C. | 270 | 245 | 245 |
| Stage 2 - Stretch - % | 0 | 0 | 0 |
| Residence Time, min. | 12 | 48 | 48 |
| Stage 3 - Temp., °C. | 270 | 260 | 260 |
| Stage 3 - Stretch - % | 0 | 0 | 0 |
| Residence Time, min. | 12 | 48 | 48 |
| Fiber Density - d/f | 1.35 | 1.35 | * |
| Stabilized Fiber Properties | | | |
| Tensile Strength, g/d | 1.4 | 1.4 | * |
| Tensile Modulus, g/d | 54.1 | 53.0 | * |
| Elongation, % | 10.3 | 8.0 | * |

Comp = Comparative
* = broken tow

As can be seen from Table I, Run B, utilizing temperatures below those of Run A, i.e. those normally employed in carbon fiber precursor stabilization, requires 2 hours of total residence time to achieve a stabilized fiber having properties substantially equivalent to those of the fiber resulting from Run A. Run C shows, that when utilizing temperatures similar to those of Run B while stretching in accordance with Run A, the tow breaks and no useful fiber results.

EXAMPLE 2

(Comparative)

When the procedure of Example 1, Run B, is again followed, fiber tow begins to break at 7% stretch in stage 1 and at 10% stretch substantially complete break occurs.

EXAMPLE 3

A precursor fiber tow containing 3,000, 1.3 denier filaments of the polymer of Example 1, is subjected to stabilization according to the conditions set forth in Table II, below (Runs E, F, H and I). Comparative runs utilizing conditions outside the scope of the process of the present invention, (Runs D and G) and other, commercially available, carbon fiber precursors (Runs H and I) are also shown. The stabilized fibers are subsequently carbonized by passing the fibers through a detarring furnace at a temperature of 600° C. while the fiber is stretched 4%. The tow is then exposed to a graphtizing temperature of 1250° C. for 30 seconds while relaxing 5%. Carbon fiber properties are also shown in Table II.

TABLE II

| STABILIZATION RUN | D (Comp) | E | F | G[1] (Comp) | H[1] | I[2] |
|---|---|---|---|---|---|---|
| Total Residence Time, Min. | 150 | 30 | 20 | 150 | 30 | 30 |
| Stage 1 Temperature, °C. | 235 | 250 | 250 | 235 | 250 | 250 |
| Stage 1 Stretch, % | 5 | 25 | 25 | 3 | 25 | 25 |
| Stage 1 Residence Time, Min. | 30 | 6 | 4 | 30 | 6 | 6 |
| Stage 2 Temperature, °C. | 245 | 270 | 270 | 245 | 270 | 270 |
| Stage 2 Stretch, % | 0 | 0 | 0 | 0 | 0 | 0 |
| Stage 2 Residence Time, Min. | 60 | 12 | 8 | 60 | 12 | 12 |
| Stage 3 Temperature, °C. | 260 | 270 | 270 | 255 | 270 | 270 |
| Stage 3 Stretch, % | 0 | 0 | 0 | 0 | 0 | 0 |
| Stage 3 Residence Time | 60 | 12 | 8 | 60 | 12 | 12 |
| Fiber Density - d/f | 1.36 | 1.34 | 1.34 | 1.37 | 1.35 | 1.34 |
| Carbon Fiber Properties | | | | | | |
| Tensile Strength $\times 10^3$ - psi | 385 | 438 | 427 | 355 | 479 | 91 |
| Tensile Modulus $\times 10^6$ - psi | 42 | 37 | 36 | 44 | 40 | 27 |
| Elongation - % | 0.93 | 1.2 | 1.3 | 0.8 | 1.3 | 0.04 |

Comp = Comparative;
[1]First commercially available fiber;
[2]second commercially available fiber A comparison of Runs E and F of Table II with Run D clearly shows that the process of the present invention (Runs E and F) produce carbon fibers having properties at least equivalent to, if not superior to, those using the lower stabilization temperatures of the prior art procedures (Run D).

A comparison of Runs G[1] and H[1], runs using a different, commercially available, carbon fiber precursor, substantiates the above conclusion, i.e. Run H[1], using the present process, results in a carbon fiber at least as good as the prior art process, Run G[1]. Run I[2], using the present process, provided a very poor carbon fiber, probably because the fiber was damaged during stabilization by the temperatures employed. Since the exact structural and chemical nature of the precursor fibers of Run I[2] is not known, further discussion of why the polymer failed is pure speculation.

EXAMPLE 4

Following the procedure of Example 1 (Run A) except that the polymer comprises 91.2% acrylonitrile, 4.8% methylmethylacrylate, 2.0% methacrylic acid and 2.0% -hydroxypropylacrylate, similar results are achieved.

EXAMPLE 5

Utilizing the same polymer fiber as set forth in Example 1, the polymer is subjected to stabilization in accordance with the conditions set forth in Table III, below. The stabilized fiber is subsequently carbonized by passing the fiber through a detarring furnace at a temperature of 600° C. for 30 seconds while the fiber is stretched 4%, and then graphitized by passing the carbonized fiber at 1350° C. for 30 seconds while relaxing 5%. The resultant carbon fiber properties are also shown in Table III.

TABLE III

| Stabilization Run | J |
|---|---|
| Total Residence Time - Min. | 31.3 |
| Stage 1 - Temperature - °C. | 250 |
| Stage 1 - Stretch - % | 25 |

TABLE III-continued

| Stabilization Run | J |
|---|---|
| Stage 1 - Residence Time - Min. | 7.5 |
| Stage 2 - Temperature - °C. | 270 |
| Stage 2 - Stretch - % | 0 |
| Stage 2 - Residence Time - Min. | 11.9 |
| Stage 3 - Temperature - °C. | 270 |
| Stage 3 - Stretch - % | 0 |
| Stage 3 - Residence Time - Min. | 11.9 |
| Fiber Density - d/f | 1.34 |
| Stabilized Fiber Properties | |
| Tensile Strength - g/d | 1.6 |
| Tensile Modular - g/d | 55.0 |
| Elongation - % | 13.0 |
| Total Denier | 3580 |
| Carbon Fiber Properties | |
| Tensile Strength $\times 10^3$ - psi | 456 |
| Tensile Modulus $\times 10^6$ - psi | 27.0 |
| Elongation - % | 1.6 |
| Density - g/cm$^3$ | 1.784 |

We claim:

1. In a method for the production of a carbon fiber precursor wherein an acrylonitrile polymer fiber is subjected to oxidation by heating said fiber in an oxidizing atmosphere for a time sufficient to permit substantially complete permeation of oxygen throughout the fiber structure, the improvement which comprises conducting said oxidation in at least two stages, the first stage at a temperature substantially at which the maximum plasticity of the polymer is attained while stretching said fiber from about 10–50% and the second stage under a tension of from about 0.01–0.2 g/d, and at a temperature ranging from about 200° to 300° C. but higher than the temperature in said first stage, the total residence time of said fiber during said oxidation ranging from about 15–60 minutes.

2. A method according to claim 1 wherein said oxidation is conducted in three stages, the third stage under said tension and at a temperature ranging from about 200°–300° C., but at least equal to that temperature of said second stage.

3. A method according to claim 1 wherein said polymer is a copolymer of acrylonitrile; methyl methacrylate and methacrylic acid.

4. A method according to claim 1 wherein the temperature in said second stage ranges from about 220°–270° C.

5. A method according to claim 1 wherein the temperature in said second stage ranges from about 220°–270° C. and the temperature in said third stage ranges from about 240–300° C.

6. A method according to claim 1 wherein said residence time in said second stage is at least about twice that of said first stage.

7. A method according to claim 2 wherein said residence time in said third stage is about equal to that of said second stage.

8. A method according to claim 1 wherein said polymer is a copolymer of acrylonitrile, methylmethacrylate, methacrylic acid and $\beta$-hydroxypropylacrylate.

9. A method according to claim 1 wherein the oxidized carbon fiber precursor is subjected to carbonizing conditions.

* * * * *